United States Patent [19]

Lefebvre et al.

[11] 4,227,691

[45] Oct. 14, 1980

[54] BATTING TEE

[75] Inventors: James K. Lefebvre; Benny M. Lefebvre, both of Playa Del Rey; Gilbert H. Lefebvre, San Juan Capistrano, all of Calif.

[73] Assignee: Lefebvre, Inc., San Juan Capistrano, Calif.

[21] Appl. No.: 947,171

[22] Filed: Sep. 28, 1978

[51] Int. Cl.[2] ..... A63B 69/40

[52] U.S. Cl. ..... 273/26 R

[58] Field of Search ..... 273/26 R, 202, 33, 25; 272/78

[56] References Cited

U.S. PATENT DOCUMENTS

| | | | |
|---|---|---|---|
| 1,420,676 | 6/1922 | Angell | 272/78 |
| 3,039,770 | 6/1962 | Ferretti | 273/26 R |
| 3,139,282 | 6/1964 | Lande | 273/26 R |

OTHER PUBLICATIONS

Popular Science, 3/1959, p. 183.

*Primary Examiner*—Richard C. Pinkham
*Assistant Examiner*—T. Brown
*Attorney, Agent, or Firm*—Knobbe, Martens, Olson, Hubbard & Bear

[57] ABSTRACT

A batting tee comprising a planar base adapted to rest on the ground, the base having a plurality of holes therein and being a representation of a baseball home plate, an elongate, length-adjustable, telescopic member, such member including an elongate pipe being externally threaded at one end thereof, such one end of the pipe being extendable through any one of the holes in the base, and a disc having an internally threaded central hole for receipt of the one end of the pipe for removably connecting the telescopic member to any one of the holes in the base, the member supporting a ball above the selected hole in the base.

9 Claims, 3 Drawing Figures

BATTING TEE

BACKGROUND OF THE INVENTION

1. Field of the Invention

The present invention relates to a batting tee and, more particularly, to a multiple position, disassemblable batting tee.

2. Description of the Prior Art

In the game of baseball, one of the most difficult skills to master is that of batting. First, a hitter must be able to coordinate the swing of a bat with the location of a ball so that good contact with the ball can be made while swinging the bat. Once this is mastered, the hitter must next learn to make good contact with the ball at the various positions at which it may cross home plate, from an inside pitch to an outside pitch, and from a high pitch to a low pitch, and various combinations of these two variables.

In the development of these skills, it has been known to provide a baseball tee for supporting a ball at a selected height above a representation of a baseball home plate. With the ball so positioned, the batter can practice swinging thereat to assist in the process of coordinating his hands with his eyes.

A typical batting tee comprises a planar base having the appearance of a baseball home plate with an elongate, length-adjustable member, one end of the member being rigidly connected to the base, typically at the center thereof, the other end of the member being adapted to receive a ball for supporting the ball at a variable height above the base. While such batting tees are widely used, a number of problems exist therewith.

First of all, the tee is capable of supporting a ball at only one horizontal position relative thereto. If a hitter wants to practice hitting inside pitches or outside pitches, he must move his position relative to the home plate to change the relative location between himself and the ball. Unfortunately, this disorients the hitter who is used to assuming a fixed position relative to home plate.

Existing batting tees are usually neither strong nor stable and require glueing, welding, pinning, or the like for connecting the length-adjustable member to the base. The process of packing the shaft is often with one part epoxy; a two part sealing process with the inherent packing cover. As a result, the length-adjustable members are often broken or disconnected from the base when a hitter inadvertently strikes the member rather than the ball when swinging a bat. Furthermore, the assembly procedures for such batting tees often result in a considerable expense for the finished product.

Still further, existing batting tees cannot be readily disassembled, and some cannot be disassembled at all. This makes it inconvenient to package and ship the unit and presents storage problems. Furthermore, a hitter cannot readily take the tee with him wherever he goes for use in practicing batting.

SUMMARY OF THE INVENTION

According to the present invention, there is provided a batting tee which solves these problems in a manner unknown heretofore. The present batting tee is capable of supporting a ball at a number of different horizontal positions relative to a baseball home plate. In this manner, a batter, whether right-handed or left-handed, can practice hitting both inside and outside pitches, in addition to pitches over the center of home plate, without changing his position relative to home plate. The present batting tee is strong, stable, and simple in construction and not likely to break in the presence of impact forces thereon. Furthermore, the present batting tee can be readily disassembled so that a hitter can take the batting tee with him wherever he goes and store it in a small space.

Briefly, the present batting tee comprises a planar base adapted to rest on the ground, and having a plurality of holes therein and being a representation of a baseball home plate; an elongate, length-adjustable, telescoping member, such member including an elongate pipe being externally threaded at one end thereof, such one end of the pipe being extendable through any one of the holes in the base; and a disc having an internally threaded central hole for receipt of one end of the pipe for removably connecting the telescoping member to any one of the holes in the base, the member supporting a ball above the selected hole in the base.

OBJECTS

It is therefore an object of the present invention to provide a strong and stable batting tee, which is simple in construction, and easily assembled for use and disassembled for transport and storage.

It is a further object of the present invention to provide a batting tee capable of supporting a ball at multiple positions representing different positions of a pitched ball relative to a home plate.

It is a still further object of the present invention to provide a batting tee in which the position of the supported ball may be readily changed.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

DETAILED DESCRIPTION OF THE PREFERRED EMBODIMENT

Figure 1:
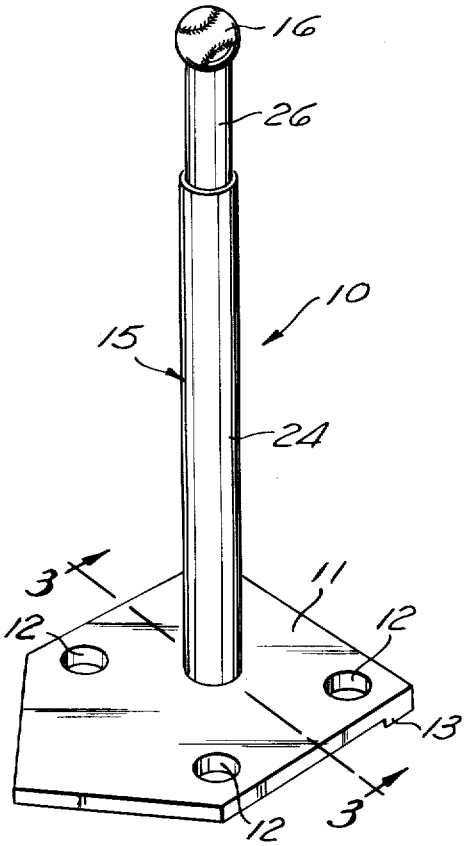
FIG. 1 is a perspective view of a batting tee constructed in accordance with the teaching of the present invention.
Figure 2:
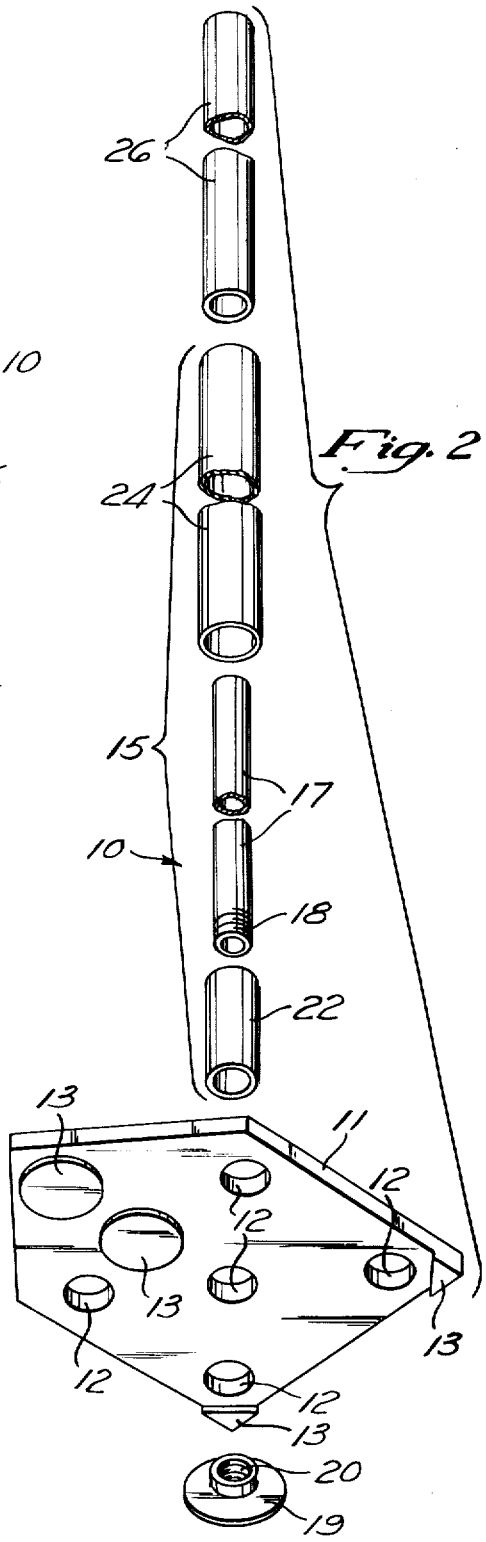
FIG. 2 is an exploded perspective view of the batting tee of FIG. 1.

Referring now to the drawings, there is shown a batting tee, generally designated 10, constructed in accordance with the teachings of the present invention. The tee 10 includes a base 11 preferably made from rubber and having the configuration of a baseball home plate. The base 11 preferably has five holes 12 therein, evenly distributed thereover. One hole 12 is located approximately in the center of the base 11. Two other holes 12 are positioned towards the front of the base 11, near opposite side edges thereof, whereas the remaining two holes 12 are positioned towards the rear of the base 11, near opposite side edges thereof. These holes 12 represent the different horizontal positions relative to a home plate at which a hitter wants to practice hitting a baseball.

Connected to the bottom of the base 11 is a plurality of pads 13, preferably made of the same material as the base 11. The pads 13 are distributed over the bottom surface of the base 11 and may have any desired configuration. The pads 13 provide a stable support for the base 11 and elevate the base 11 slightly above the surface of the ground, for reasons which will appear more fully hereinafter.

The batting tee 10 further comprises an elongate, length-adjustable member, generally designated 15, one end of which is adapted to be removably connected to any one of holes 12 in the base 11, the other end of the member 15 being adapted to receive a ball for supporting the ball 16 above the selected hole in the base 11. More particularly, the length-adjustable member 15 includes a rigid elongate pipe 17 which is preferably made from steel, having a length of approximately 18". One end of the pipe 17 is externally threaded, at 18, the threaded end of the pipe 17 being extendable through any one of holes 12 in the base 11.

To connect the pipe 17 to the base 11, the tee 10 includes a disc 19, which is preferably made from a strong, rigid material, such as steel. The disc 14 is preferably of a thickness of approximately ½" and has an internally threaded central hole 20 having threads matching the threads 18 on the pipe 17. The disc 19 may be positioned between the base 11 and the ground since the pads 13 elevate the base 11 sufficiently to permit positioning the disc 19 therebelow. With the threads 18 on the pipe 17 engaged in the hole 20 of the disc 19, the pipe 17 extends upwardly from the base 11, through any one of the holes 12 therein.

Figure 3:
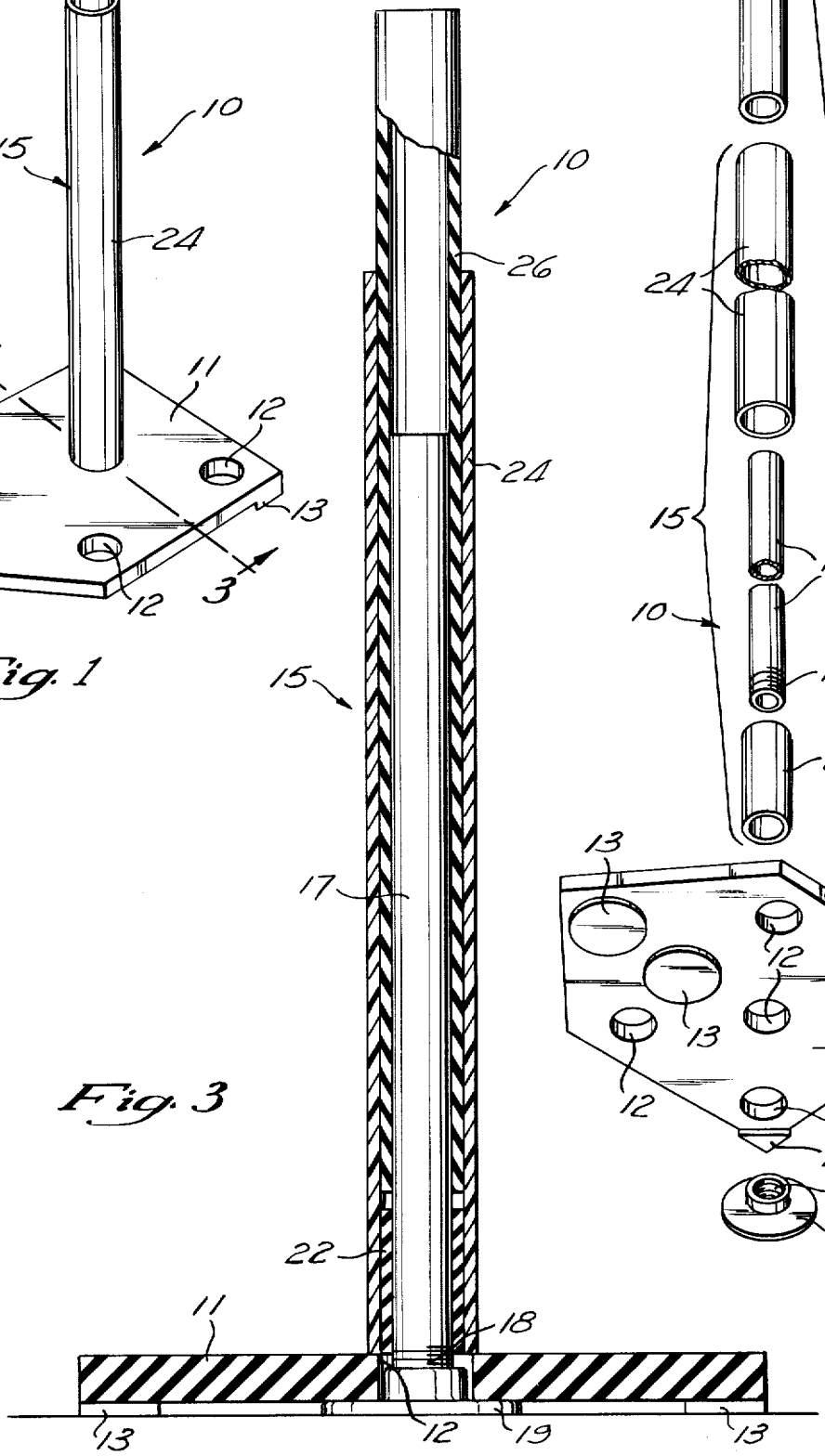
FIG. 3 is a sectional view taken along the line 3—3 in FIG. 1, but showing the internal pipe in elevation.

The member 15 further comprises a tubular collar 22, made from a shock-absorbing material, such as rubber, and having an inside diameter which is approximately equal to, or very slightly larger than, the outside diameter of the pipe 17. The collar 22 is preferably about 3 inches in length. As best shown in FIG. 3, the threaded end of the pipe 17 is inserted through the collar 22 so as to expose the threads 18 below the bottom of the collar 22, with the collar 22 being firmly attached to the pipe 17 by a suitable adhesive, such as glue or epoxy.

The member 15 further comprises an elongate, tubular outer sleeve 24 having a length of approximately 20" and an inside diameter which is approximately equal to, or very slightly larger than, the outside diameter of the collar 22. The outer sleeve 24 may be a length of plastic hose, but any suitable impact-absorbing material may be used. The outer sleeve 24 is fitted over the exterior of the collar 22 so that the bottom ends of the collar 22 and the outer sleeve 24 are substantially flush with one another. The collar 22 and the outer sleeve 24 are preferably bonded, as by epoxy, or otherwise glued together so as to maintain a rigid connection therebetween. Thus, when the threaded end of the pipe 17 is inserted into one of the holes 12 in the base 11, the bottom end of the outer sleeve 24 will abut against the upper surface of the base 11 around the periphery of the hole 12, and the threads 18 will extend into the hole 12 so as to engage the threaded central hole 20 of the disc 19. The disc 19 will thus be held firmly onto the pipe 17 and against the bottom surface of the base 11, with the firm connections between the pipe 17, and collar 22, and the outer sleeve 24 maintaining the member 15 in a rigid position substantially perpendicular to the base 11.

Finally, the member 15 includes an elongate, tubular inner sleeve 26 having a length of approximately 21", an inside diameter which is approximately equal to or slightly larger than, the outside diameter of the pipe 17, and an outside diameter which is approximately equal to the inside diameter of the outer sleeve 24. The inside and outside diameters of the inner sleeve 26 are selected to provide a slidable frictional fit between the inner sleeve 26 and the pipe 17 and the outer sleeve 24 respectively. The inner sleeve 26 may be made from any suitable shock-absorbing material and may be conveniently made from the same material as the collar 22. For example, the collar 22 and the inner sleeve 26 may be made from a single piece of rubber hose, cut to the different lengths required.

As shown in FIG. 3, the inner sleeve 26 is positionable, above the collar 22, between the pipe 17 and the outer sleeve 24 for vertical movement relative thereto. Because of the frictional engagement between the exterior surface of the inner sleeve 26 and the interior surface of the outer sleeve 24, the inner sleeve 26 may be moved vertically relative to the pipe 17 and the outer sleeve 24, and it will remain in any vertical position selected therefor, even under the weight of the ball 16 positioned on the upper end of the inner sleeve 26. This permits adjustment of the length of the member 15 and adjustment of the height of the ball 16 relative to the base 11.

In operation, the tee 10 is readily assembled by first placing the disc 19 under the selected hole 12 of the base 11, so that the threaded hole 20 of the disc 19 is exposed through the hole 12. The outer sleeve 24, the collar 22, and the pipe 17 (which have been pre-assembled in the manner described above) are then placed on the base 11 so that the threaded end of the pipe 17 enters the hole 12, with the threads 18 engaging the threads in the hole 20 of the disc 19. The assembly is then tightened until the bottom end of the outer sleeve 24 engages firmly with the upper surface of the base 11 around the periphery of the hole 12. Finally, the inner sleeve 26 is inserted into the open upper end of the outer sleeve 24, with the pipe 17 passing through the interior of the inner sleeve 26. The inner sleeve 26, because of its frictional engagement with the outer sleeve 24, may be moved vertically relative to the outer sleeve 24 to adjust the height of the end of the inner sleeve 26 which extends externally of the outer sleeve 24 and which receives the ball 16. The tee 10 is then ready to be used for batting practice in the manner known to those skilled in the art.

If a hitter now desires to practice hitting baseballs at a different position relative to the base 11, the position of the member 15 is readily moved simply by disengaging the disc 19, changing the position of the member 15 to another of the holes 12, and re-engaging the disc 19, as described above. Furthermore, the disc 19 may be disconnected from the pipe 17 to disassemble the tee 10 for transportation or storage thereof.

It can therefore be seen that according to the present invention, there is provided a novel batting tee 10 which solves the problems encountered heretofore. The base 11 has five holes 12 therein, allowing a hitter who is either left-handed or right-handed to practice hitting inside pitches, outside pitches and pitches over the middle of home plate to fully develop his batting skills. The construction of the member 15 makes the tee 10 strong and stable and allows the tee 10 to take impact forces without breaking any portion thereof.

By positioning the inner sleeve 26 between the pipe 17 and the outer sleeve 24, several goals are achieved. The length of the member 15 can be adjusted, the outer sleeve 24 is protected from being cut by the pipe 17, and the necessary friction is created to hold the inner sleeve 26 in place when pressure is placed on the top thereof by the ball 16. As a result of the construction of the batting tee 10, no glueing, welding, or pinning is required between the member 15 and the base 11, allowing the tee 10 to be assembled and disassembled with relative ease.

While the invention has been described with respect to a preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

What is claimed is:

1. A batting tee for holding a ball comprising:

a planar base adapted to rest on the ground, said base having a plurality of holes therein;

an elongate pipe being externally threaded at one end thereof, said one end of said pipe being insertable into any one of said holes in said base;

disc-shaped means for removably connecting said one end of said pipe to the selected hole in said base, said disc-shaped means having an internally threaded hole for receipt of said one end of said pipe, said disc-shaped means being positioned between said base and the ground, with said pipe extending upwardly from said base;

a collar of shock-absorbing material surrounding said pipe proximate said one end thereof;

a first elongate sleeve having an inside diameter approximately equal to the outside diameter of said collar, one end of said sleeve extending over said collar and engaging said base, said pipe extending longitudinally into said sleeve; and a height-adjustable elongate member slidably engaging said pipe and said sleeve, one end of said member being adapted to receive and support a ball above the selected hole in said base.

2. A batting tee according to claim 1, wherein said base is a representation of a baseball home plate.

3. A batting tee according to claim 1, wherein said height-adjustable member comprises:

a second elongate sleeve having an inside diameter approximately equal to the outside diameter of said pipe and an outside diameter approximately equal to the inside diameter of said first sleeve, said second sleeve being slidably positionable between said pipe and said first sleeve for vertical sliding movement relative thereto, said second sleeve having an end which is positioned externally of said first sleeve, said end receiving and supporting said ball above said base.

4. A batting tee, comprising:

a planar base;

length-adjustable means for supporting a ball above said base, said length-adjustable means comprising:

an outer tubular member;

an inner tubular member slidably engaging the interior of said outer tubular member and having one end extending externally of said outer tubular member for receiving said ball; and an elongate pipe extending longitudinally into the interior of said inner tubular member so that said inner tubular member is slidable between said pipe and said outer tubular member;

means in said base for defining a plurality of positions at which said length-adjustable means may be attached to said base; and means for removably connecting said pipe to said base at a preselected one of said plurality of positions.

5. A batting tee according to claim 4, wherein said position-defining means comprises a plurality of holes in said base.

6. A batting tee according to claim 4, wherein said position-defining means comprises a plurality of holes in said base, said connectable end of said pipe is insertable into a preselected one of said plurality of holes, and said means for removably connecting said length-adjustable means to said base comprises a rigid member which is engageable with said connectable end of said pipe and with said base.

7. A batting tee according to claim 6, wherein said connectable end of said pipe is threaded and said rigid member includes a threaded portion which is engageable with said threaded end of said pipe.

8. A batting tee according to claim 6, wherein said connectable end of said pipe includes external threads, and said rigid member comprises a disc having internally threaded means for engagement with said external threads, said disc being positioned between said base and the surface on which said base rests.

9. A batting tee for holding a ball comprising:

a planar base having a plurality of holes therein;

means on the bottom surface of said base for supporting said base a small distance above the ground;

elongate, length-adjustable means for supporting a ball above said base, comprising:

a vertically extending pipe having an externally threaded end insertable into a preselected one of said plurality of holes;

a short tubular collar attached to said pipe just above said threaded end;

an elongate outer tubular sleeve attached around the exterior surface of said collar and extending upwardly therefrom, and having a bottom end substantially flush with the bottom end of said collar; and an elongate inner tubular sleeve slidably positioned between said pipe and said outer tubular sleeve above said collar and having an exterior surface which frictionally engages the interior surface of said outer sleeve, and having an upper end for receiving said ball; and a disc having an internally threaded hole engageable with said threaded end of said pipe, said disc being positioned between said base and the ground.

* * * * *